US012318837B2

(12) United States Patent
Merrill et al.

(10) Patent No.: US 12,318,837 B2
(45) Date of Patent: Jun. 3, 2025

(54) INVESTMENT CASTING PROCESS FOR HOLLOW COMPONENTS

(71) Applicant: Mikro Systems, Inc., Charlottesville, VA (US)

(72) Inventors: Gary Merrill, Orlando, FL (US); Andrew Burns, Longwood, FL (US); Michael Appleby, Crozet, VA (US); Iain Fraser, Ruckersville, VA (US); John Paulus, Afton, VA (US)

(73) Assignees: SIEMENS ENERGY, INC., Orlando, FL (US); RAYTHEON TECHNOLOGIES CORPORATION, Waltham, MA (US)

( * ) Notice: Subject to any disclaimer, the term of this patent is extended or adjusted under 35 U.S.C. 154(b) by 256 days.

(21) Appl. No.: 15/050,503

(22) Filed: Feb. 23, 2016

(65) Prior Publication Data

US 2016/0167115 A1 Jun. 16, 2016

Related U.S. Application Data

(63) Continuation of application No. 12/961,720, filed on Dec. 7, 2010, now Pat. No. 9,272,324.

(Continued)

(51) Int. Cl.

*B22C 9/10* (2006.01)
*B22C 7/02* (2006.01)

(Continued)

(52) U.S. Cl.

CPC ..... *B22C 9/101* (2013.01); *B22C 7/02* (2013.01); *B22C 7/06* (2013.01); *B22C 9/04* (2013.01);

(Continued)

(58) Field of Classification Search

CPC .... B22C 9/10; B22C 9/24; B22C 7/06; B22C 1/205; B22C 1/226

See application file for complete search history.

(56) References Cited

U.S. PATENT DOCUMENTS 1,426,621 A * 8/1922 Walther ..... B22C 7/00 164/249
3,582,517 A * 6/1971 Bailey et al. ..... C04B 26/14 523/220

(Continued)

FOREIGN PATENT DOCUMENTS

CN 1608771 A 4/2005
DE 102007023152 A1 11/2008

(Continued)

OTHER PUBLICATIONS

Peridot, Inc. "Cast Urethane Models & Low Volume Production", <http://www.peridotinc.com/urethane-castings.html>, Internet Archive dated Apr. 16, 2009. (Year: 2009).*

*Primary Examiner* — Kevin E Yoon
*Assistant Examiner* — Jacky Yuen
(74) *Attorney, Agent, or Firm* — CANTOR COLBURN LLP

(57) ABSTRACT

An investment casting process for a hollow component such as a gas turbine blade utilizing a ceramic core (10) that is cast in a flexible mold (24) using a low pressure, vibration assisted casting process. The flexible mold is cast from a master tool (14) machined from soft metal using a relatively low precision machining process, with relatively higher precision surfaces being defined by a precision formed insert (22) incorporated into the master tool. A plurality of identical flexible molds may be formed from a single master tool in order to permit the production of ceramic cores at a desired rate with a desired degree of part-to-part precision.

19 Claims, 2 Drawing Sheets

Related U.S. Application Data

(60) Provisional application No. 61/267,519, filed on Dec. 8, 2009.

(51) Int. Cl.
*B22C 7/06* (2006.01)
*B22C 9/04* (2006.01)
*B22C 9/24* (2006.01)

(52) U.S. Cl.
CPC ..... *B22C 9/10* (2013.01); *B22C 9/103* (2013.01); *B22C 9/24* (2013.01)

(56) References Cited

U.S. PATENT DOCUMENTS 3,850,559 A 11/1974 Mintz et al.
3,880,790 A 4/1975 McLaren et al.
4,078,598 A 3/1978 Kelso et al.
4,283,835 A 8/1981 Obrochta et al.
4,297,457 A * 10/1981 Stark, Jr. ..... C08G 59/682 525/507
4,732,204 A 3/1988 Tabardin
4,840,764 A 6/1989 Cummins
4,844,853 A 7/1989 Ito et al.
5,133,816 A * 7/1992 Mills ..... B22C 9/103 156/307.1
5,225,133 A * 7/1993 Ihara ..... C25D 1/10 264/163
5,252,273 A * 10/1993 Sakai ..... B28B 7/342 264/221
5,258,151 A * 11/1993 Bayer ..... B22F 1/0059 264/109
5,291,654 A 3/1994 Judd et al.
5,394,932 A * 3/1995 Carozza ..... B22C 1/00 164/137
5,639,416 A * 6/1997 Pennisi ..... B29C 33/50 249/139
5,651,932 A 7/1997 Butler
5,906,234 A 5/1999 Mastrorio et al.
5,976,457 A 11/1999 Amaya et al.
6,019,927 A 2/2000 Galliger
6,352,101 B1 3/2002 Ghosh et al.
6,364,001 B1 4/2002 Cross
6,403,020 B1 * 6/2002 Altoonian ..... B22C 9/12 264/234
6,511,622 B1 1/2003 Vihtelic et al.
6,634,410 B1 10/2003 Wilson et al.
7,141,812 B2 11/2006 Appleby et al.
7,410,606 B2 8/2008 Appleby et al.
7,411,204 B2 8/2008 Appleby et al.
7,438,527 B2 10/2008 Albert et al.
2002/0117601 A1 * 8/2002 Keller ..... B22C 3/00 249/175
2002/0148589 A1 10/2002 Mertins
2003/0116300 A1 6/2003 Bramley
2005/0133193 A1 * 6/2005 Beals ..... B22C 7/02 164/516
2005/0199365 A1 * 9/2005 Pfeifer ..... B22C 7/06 164/132
2005/0274478 A1 12/2005 Verner et al.
2006/0065383 A1 * 3/2006 Ortiz ..... B22C 7/00 164/4.1
2007/0063378 A1 3/2007 O'Donoghue
2008/0006384 A1 1/2008 Memmen
2008/0135721 A1 * 6/2008 Wang ..... B22C 1/183 249/175
2009/0308559 A1 12/2009 Powell
2011/0132564 A1 6/2011 Merrill et al.
2011/0189440 A1 8/2011 Appleby et al.
2013/0333855 A1 12/2013 Merrill et al.

FOREIGN PATENT DOCUMENTS

GB 821282 A * 10/1959 ..... B22F 3/1208
JP 2000301289 A 10/2000

* cited by examiner

INVESTMENT CASTING PROCESS FOR HOLLOW COMPONENTS

CROSS REFERENCE TO RELATED APPLICATION

This application claims benefit of the 8 Dec. 2009 filing date of U.S. provisional application No. 61/267,519, incorporated by reference in its entirety herein.

FIELD OF THE INVENTION

This invention relates to the field of investment casting.

BACKGROUND OF THE INVENTION

Investment casting is one of the oldest known metal-forming processes, dating back thousands of years to when it was first used to produce detailed artwork from metals such as copper, bronze and gold. Industrial investment castings became more common in the 1940's when World War II increased the demand for precisely dimensioned parts formed of specialized metal alloys. Today, investment casting is commonly used in the aerospace and power industries to produce gas turbine components such as blades or vanes having complex airfoil shapes and internal cooling passage geometries.

The production of an investment cast gas turbine blade or vane involves producing a ceramic casting mold having an outer ceramic shell with an inside surface corresponding to the airfoil shape, and one or more ceramic cores positioned within the outer ceramic shell, corresponding to interior cooling passages to be formed within the airfoil. Molten alloy is introduced into the ceramic casting mold and is then allowed to cool and to harden. The outer ceramic shell and ceramic core(s) are then removed by mechanical or chemical means to reveal the cast blade or vane having the external airfoil shape and hollow interior cooling passages in the shape of the ceramic core(s).

A ceramic core for injection casting is manufactured by first precision machining the desired core shape into mating core mold halves formed of high strength hardened machine steel, then joining the mold halves to define an injection volume corresponding to the desired core shape, and vacuum injecting a ceramic molding material into the injection volume. The molding material is a mixture of ceramic powder and binder material. Once the ceramic molding material has hardened to a green state, the mold halves are separated to release the green state ceramic core. The fragile green state core is then thermally processed to remove the binder and to sinter the ceramic powder together to create a material that can withstand the temperature requirements necessary to survive the casting of the molten alloy. The complete ceramic casting vessel is formed by positioning the ceramic core within the two joined halves of another precision machined hardened steel mold (referred to as the wax pattern mold or wax pattern tool) which defines an injection volume that corresponds to the desired airfoil shape of the blade, and then vacuum injecting melted wax into the wax mold around the ceramic core. Once the wax has hardened, the wax mold halves are separated and removed to reveal the ceramic core encased inside a wax pattern, with the wax pattern now corresponding to the airfoil shape. The outer surface of the wax pattern is then coated with a ceramic mold material, such as by a dipping process, to form the ceramic shell around the core/wax pattern. Upon sintering of the shell and consequential removal of the wax, the completed ceramic casting mold is available to receive molten alloy in the investment casting process, as described above.

The known investment casting process is expensive and time consuming, with the development of a new blade or vane design typically taking many months and hundreds of thousands of dollars to complete. Furthermore, design choices are restricted by process limitations in the production of ceramic cores because of their fragility and an inability to achieve acceptable yield rates for cores having fine features or large sizes. The metals forming industry has recognized these limitations and has developed at least some incremental improvements, such as the improved process for casting airfoil trailing edge cooling channels described in U.S. Pat. No. 7,438,527. As the market demands ever higher efficiency and power output from gas turbine engines, the limitations of existing investment casting processes become ever more problematic.

SUMMARY OF THE INVENTION

While incremental improvements have been presented in the field of investment casting technology, the present inventors have recognized that the industry is faced with fundamental limitations that will significantly inhibit component designs for planned advances in many fields, for example in the next generation of gas turbine engines. Gas turbine firing temperatures continue to be increased in order to improve the efficiency of combustion, and gas turbine hot gas path component sizes continue to increase as power levels are raised, so there is now a need to design an internally cooled $4^{th}$ stage gas turbine blade in excess of a meter in length. No such blade has heretofore been produced, nor is it believed that such a blade can be produced effectively with today's existing technology. In prior art turbines, there was no need for internal cooling of the $4^{th}$ stage due to the high temperature capability of available superalloys. Due to increased firing temperatures, the next generation $4^{th}$ stage turbine blades will exceed the operating limits of these known alloys and will require active internal cooling passages to protect the integrity of the component. However, due to the complex cooling design and projected size of these new blades, the ceramic cores that would be necessary for investment casting of such cooling passages are beyond the commercially practical capabilities of existing investment casting processes. Similar limitations may be experienced in other industries as desired designs exceed casting capabilities.

As a result, the present inventors have developed and are disclosing herein an entirely new regiment for investment casting. This new regiment not only extends and refines existing capabilities, but it also provides new and previously unavailable design practicalities for the component designer. As a result, the processes disclosed herein enable the timely and cost efficient production of cast metal alloy components having feature geometries that may be larger or smaller than currently available geometries, may be more complex or shapes that could never before have been cast, and may have feature aspect ratios that were previously unattainable but that are now needed for the very long and thin cooling passages in a $4^{th}$ stage internally cooled gas turbine blade. The present invention moves casting technology beyond foreseeable needs, and it removes the casting process from being a design limitation, thereby allowing designers again to extend designs to the limits of the material properties of the cast alloys and the externally applied thermal barrier coatings.

The investment casting regiment described herein incorporates new and improved processes at multiple steps in the investment casting process. Specific aspects of the new regiment are described below in greater detail and claimed herein; however, the following summary is provided to familiarize the reader with the overall process so that the benefit of the individual steps and synergies there between may be appreciated.

An exemplary investment casting process according to a regiment described herein may start with the manufacturing of a ceramic core for an investment casting mold by using a master mold which is machined from a soft metal, i.e. a relatively soft, easily machined, and inexpensive material (when compared to the currently used high strength machine steel) such as aluminum or mild steel. Two master mold halves are formed, one corresponding to each of two opposed sides of a desired ceramic core shape. Into each master mold a flexible mold material is cast to form two cooperating flexible mold halves, which when joined together define an interior volume corresponding to the desired ceramic core shape. Ceramic mold material is then cast into the flexible mold and allowed to cure to a green state.

The cost and time to produce the master molds is minimized by the use of materials that are easily machined. However, advanced design features for the next generation of gas turbine engines may not translate well using standard machining processes in such materials. Accordingly, at least a portion of the master mold halves may be designed to receive a precision formed insert. The insert may be formed by any known process, such as a Tomo process as described in U.S. Pat. Nos. 7,141,812 and 7,410,606 and 7,411,204, all assigned to Mikro Systems, Inc. of Charlottesville, Va., and incorporated by reference herein. The Tomo process uses a metallic foil stack lamination mold to produce a flexible derived mold, which in turn is then used to cast a component part. The component design is first embodied in a digital model and is then digitally sliced, and a metal foil is formed corresponding to each slice using photolithography or other precision material removal process. The inherent precision of the two-dimensional material removal process in combination with the designer's ability to control the thickness of the various slices in the third dimension provides a degree of three-dimensional manufacturing tolerance precision that was not previously available using standard mold machining processes. The foils are stacked together to form a lamination mold for receiving suitable flexible molding material. The term "flexible" is used herein to refer to a material such as a room temperature vulcanizing (RTV) silicon rubber or other material which can be used to form a "flexible mold" which is not rigid like prior art metal molds, but that allows the mold to be bent and stretched to a degree in order to facilitate the removal of the mold from a structure cast therein. Furthermore, the terms "flexible mold" and "flexible tool" may be used herein to include a self-standing flexible structure as well as a flexible liner or insert contained within a rigid coffin mold. A component is then cast directly into the flexible mold. The flexibility of the mold material enables the casting of component features having protruding undercuts and reverse cross-section tapers due to the ability of the flexible mold material to deform around the feature as the cast part is pulled out of the mold.

In this manner, portions of the ceramic core which have a relatively low level of detail, such as long smooth channel sections, may be translated into the master mold using inexpensive standard machining processes, while other portions of the ceramic core having a relatively high level of detail, such as micro-sized surface turbulators or complex passage shapes, may be translated into the master mold using a precision mold insert. Furthermore, for cooling channel designs requiring the use of multiple cores, the mold inserts may be used to define precision cooperating joining geometries in each of the multiple cores so that when the multiple cores are jointly positioned within a wax mold, the joining geometries of the respective cores will mechanically interlock such that the multiple cores function as a single core during subsequent injection processes.

BRIEF DESCRIPTION OF THE DRAWINGS

The invention is explained in detail in the following description in view of the drawings that show.

DETAILED DESCRIPTION OF THE INVENTION

Figure 1:
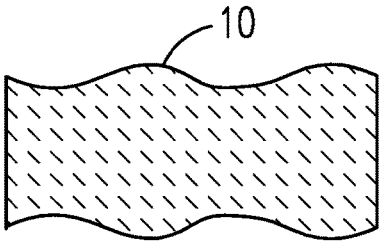
FIG. 1 illustrates a ceramic core as may be produced in accordance with aspects of the present invention.
Figure 2:
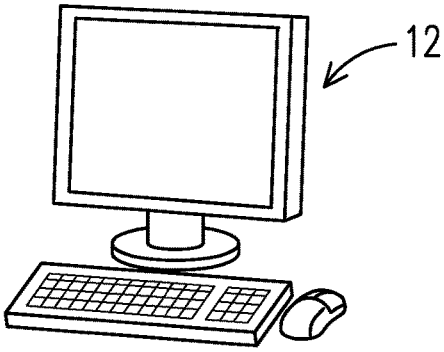
FIG. 2 PRIOR ART
FIG. 2 illustrates a prior art computerized design system as may be used during steps of the present invention.
Figure 3:
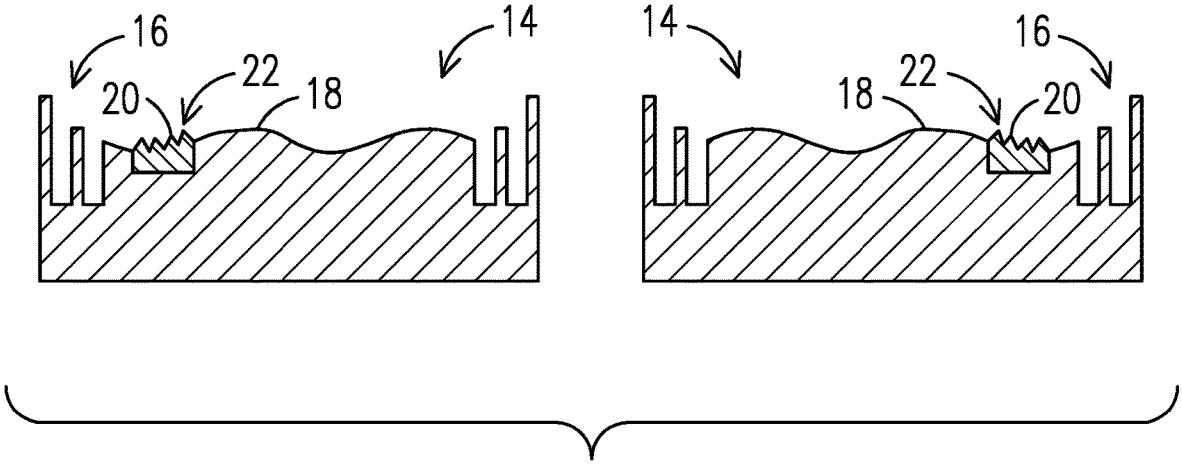
FIG. 3 illustrates two halves of a master tool incorporating precision inserts.
Figure 4:
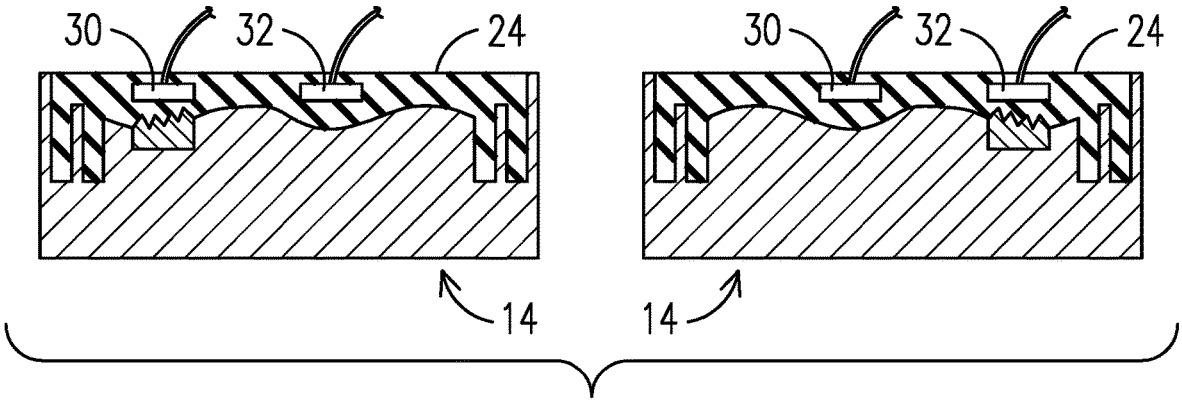
FIG. 4 illustrates a flexible mold being cast in the master tool.
Figure 5:
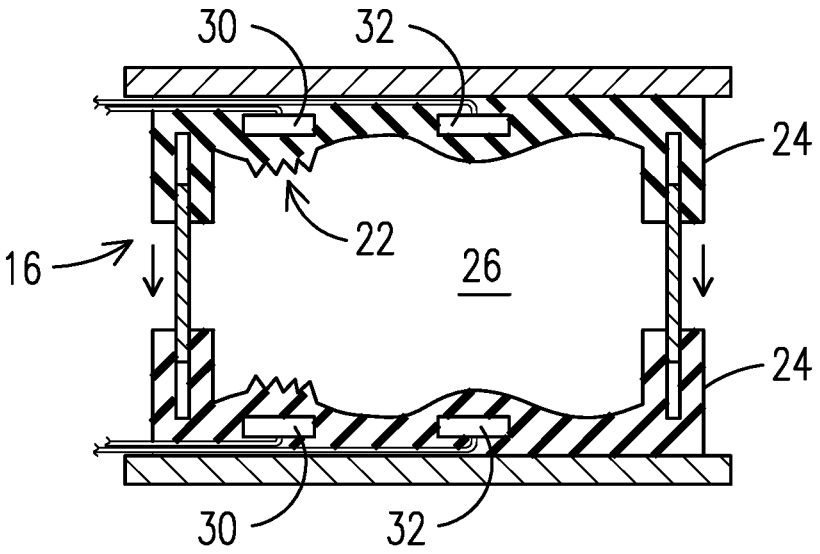
FIG. 5 illustrates the flexible mold being assembled to define a cavity corresponding to the shape of the ceramic core.
Figure 6:
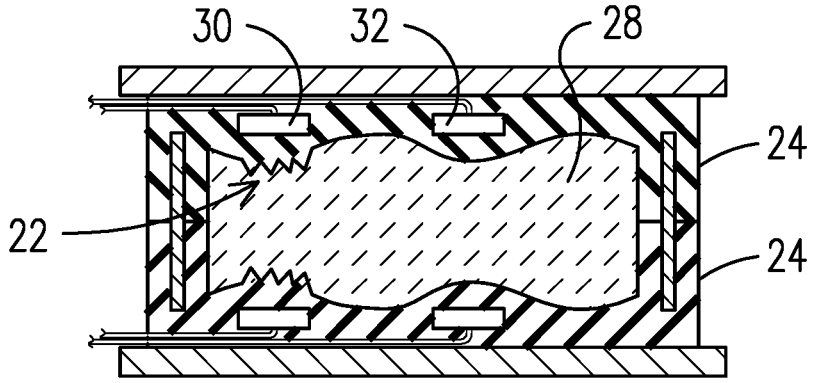
FIG. 6 illustrates the ceramic core being cast in the flexible mold.

FIGS. 1-6 illustrate steps of a process for manufacturing ceramic cores for investment casting applications. A digital model of a part such as a ceramic core 10 having a desired shape, as shown in FIG. 1, is formed using any known computerized design system 12 as in FIG. 2. That model is digitally sliced into at least two parts, usually in half, and master tools 14 are produced from the digital models using traditional machining processes and relatively low cost and easy to machine material including any soft metal such as aluminum or soft steel. Alignment features 16 may be added to the digital model for subsequent joining of the two halves If a desired surface feature of the master tool cannot be formed using a traditional machining process, a precision formed insert 22 may be installed into the master mold to incorporate the desired surface feature. The insert may be formed using a Tomo process, stereo lithography, direct metal fabrication or other high precision process. The overall tooling surface is then a hybrid of the machined surface 18 and the insert surface 20, as shown in FIG. 3 where each master tool section contains a precision formed insert. Flexible molds 24 are then cast from the master tools, as shown in FIG. 4. The flexible molds are then co-aligned and drawn together to define a cavity 26 corresponding to the desired core shape, as shown in FIG. 5. The cavity is filled with a slurry of ceramic casting material 28, as shown in FIG. 6. The flexible molds are separated once the ceramic casting material has cured to a green state to reveal the ceramic core 10. The ceramic core replicates surface features that were first produced in the precision mold inserts, such as a complex surface topography or a precision formed joint geometry. For example, a dovetail joint may be formed in a first of two ceramic core segments for mechanical joining with a corresponding geometry formed in a second mating core segment. Master tool inserts may also be useful for rapid prototype testing of alternative design schemes during development testing where the majority of a core remains the same but alternative designs are being tested for one portion of the core. In lieu of manufacturing a completely new master tool for each alternative design, only a new insert need be formed.

Prior art investment casting processes require the use of high cost, difficult to machine, hard, tool steel material for the master tool because multiple ceramic cores are cast directly from a single master tool using a high pressure injection process. The high cost results in part because the tool is a highly engineered, multi-piece system due to the need to be able to remove the rigid tool from the cast core in multiple pull planes. The hard tool steel is required because the ceramic material will abrade the tool during the high pressure injection process. In contrast, the present invention uses the master tool only for low pressure or vacuum assisted casting of flexible (e.g. rubber) mold material, as described in the above-cited U.S. Pat. Nos. 7,141,812 and 7,410,606 and 7,411,204. Thus, low strength, relatively soft, easy to machine materials may be used for the master tool, for example, a series 7000 aluminum alloy in one embodiment. This results in a significant time and cost savings when compared to prior art processes.

Another technology which can be exploited in the present invention is described in pending International Patent Application PCT/US2009/58220 also assigned to Mikro Systems, Inc. of Charlottesville, Va., and incorporated by reference herein. That application describes a ceramic molding composition that mimics existing ceramic core molding materials in its fully sintered condition, but that provides significantly improved green body strength when compared to the existing materials. Incorporating such an improved molding composition into the present casting regiment facilitates the production of core geometries that would not previously have survived handling in their green state without an unacceptably high failure rate. Improved green state strength is particularly important during the removal of a ceramic core from a flexible mold when the shape of a core feature is such that the mold must be deformed around the cast material in order to remove the core from the mold. The ceramic material cast into the flexible mold should have adequate green body strength to allow such cast features to be removed from the mold even when they contain protruding undercuts or non-parallel pull plane features requiring some bending of the flexible mold during removal of the green body ceramic core.

A ceramic casting material described in International Patent Application PCT/US2009/58220 exhibits a lower viscosity as a slurry than prior art ceramic core casting materials, thereby allowing the step of FIG. 6 to be performed at low pressure, defined for use herein as no more than 30 psi (gauge), and in one embodiment 10-15 psi., for example. Such low pressures are suitable for injection into flexible molds. In contrast, prior art ceramic core material injection is typically performed at pressures an order of magnitude higher. The present inventors have found that a vibration assisted injection of the casting material is helpful to ensure smooth flow of the material and an even distribution of the ceramic particles of the material throughout the mold cavity. The flexibility of the molds facilitates imparting vibration into the flowing casting material. In one embodiment, one or more small mechanical vibrators 30 as are known in the art are embedded into the flexible mold itself during production of the molds in the step of FIG. 3. The vibrators may then be activated during the FIG. 6 injection of the ceramic molding material in a pattern that improves the flow of the material and the distribution of the ceramic particles of the slurry throughout the mold. Other types of active devices 32 may be embedded into the flexible mold, for example any type of sensor (such as a pressure or temperature sensor), a source of heat or a source of cooling, and/or telemetry circuitry and/or antenna for data transmission.

In one embodiment, the epoxy content of the ceramic casting material could range from 28 weight % in a silica based slurry to as low as 3 weight %. The silicone resin may be a commercially available material such as sold under the names Momentive SR355 or Dow 255. This content could range from 3 weight % to as high as 30 weight %. The mix may use 200 mesh silica or even more coarse grains. Solvent content generally goes up as other resins decrease to allow for a castable slurry. The solvent is used to dissolve the silicon resin and blend with the epoxy without a lot of temperature. The Modulus of Rupture (MOR) of the sintered material is on the norm for fired silica, typically 1500-1800 psi with 10% cristobalite on a 3 point test rig. The sintered material MOR is tightly correlated to the cristobalite content, with more cristobalite yielding weaker room temperature strength. The green state MOR depends on the temperature used to cure the epoxy, as it is a high temperature thermo cure system. The curing temperature may be selected to allow for some thermo-forming, i.e. reheating the green state material to above a reversion temperature of the epoxy to soften the material, then bending it from its as-cast shape to a different shape desired for subsequent use. The reheated material may be placed into a setting die within a vacuum bag such that the part is drawn into conformance with the setting die upon drawing a vacuum in the bag. Alignment features may be cast into the core shape for precise alignment with the setting die. Advantageously, a green body MOR of at least 4,000 psi will permit the core to be removed from a flexible mold and handled with a significantly reduced chance of damage, and to provide adequate strength for it to undergo standard machining operations for adding or reshaping features either before or after reshaping in a setting die. Following such thermo-forming or in the absence of it, additional curing may be used to add strength. In one embodiment the Modulus of Rupture achieved was:

MOR cured at 110° C. for 3 hours=4000 psi

MOR cured as above and then at 120° C. for 1 hour=8000 psi.

A 10% as-fired cristobalite content may be targeted. This may be altered by the mineralizers present and the firing schedule. The 10% initial cristobalite content may be used to create a crystalline seed structure throughout the part to assure that most of the rest of the silica converts to cristobalite in a timely fashion when the core is heated prior to pouring molten metal into the ceramic mold. It also keeps the silica from continuing to sinter into itself as it heats up again.

Another parameter of concern in the investment casting business is porosity. Prior art ceramic casting material typically has about 35% porosity. The material described above typically runs around 28% porosity. The danger of a low porosity is that the cast metal cannot crush the ceramic core as it shrinks and cools, thereby creating metal crystalline damage that is referred to in the art as "hot tear". The material described above has never caused such a problem in any casting trial.

The above described regiment for producing investment casting ceramic cores compares favorably with known prior art processes, as summarized in the following Table 1.

TABLE 1

| Prior Art Characteristic | Invention Characteristic | Prior Art Capability | Invention Capability |
|---|---|---|---|
| Hard Precision Tooling (high hardness machine tool steel) | Soft Precision Tooling (aluminum master, flexible derived mold) | Single pull plane per section necessitating multiple tool sections. | Multiple pull planes reduces # of tool sections, increases design freedom |
| | | Linear extraction only. | Curvilinear extraction capability. |
| | | Single cross section pull plane. | Multiple cross section pull planes. |
| | | Provides rigid, durable (high wear resistance) casting cavity (for HP and IP injection molding processes) | Flexible consumable casting cavity for low pressure, vibration assisted molding. |
| Low green body strength of core material | High green body strength | Limited aspect ratio | Substantially enhanced aspect ratio capability |
| | | Yield losses related to low green strength | Green strength losses eliminated |
| | | Limited join-ability of core sub assemblies (butt joints only). | Join-ability of sub assemblies enhanced through structural joint designs. |
| High viscosity of core material slurry | Low viscosity of core material slurry | Requires pressurized injection, prone to segregation (section thickness sensitive) | Low pressure injection (vacuum assisted), promotes particle size homogeneity throughout structure, section thickness insensitive |
| | | Promotes non-uniform shrinkage during thermal processing | Promotes uniform shrinkage during thermal processing |
| | | Dimensional tolerance of fired parts tailored to process limitations | Potentially improves dimensional tolerance of fired parts |
| No Green body flexibility | Thermo-formable after green body formation | None | Green body can be adjusted/modified using simple form tools |
| Precision machined tool steel die to form mold cavity | Aluminum master tool with high definition inserts applied, used to generated flexible mold, then used to form mold cavity | Very high cost and long lead time | Low cost and short lead time |
| | | Inflexible tool set, high cost to modify. | Low cost modular modifications/alterations allowed |
| | | Rigid mold cavity good for high pressure injection | Flexible mold cavity for low pressure and vibration assisted injection. |
| | | Green body extraction requires enhanced tooling features | Versatile tool ejection due to flexible nature of mold. |

Once the ceramic core is produced, it is incorporated into a ceramic casting vessel and a metal part is cast therein using known processes.

The above-described regiment enables a new business model for the casting industry. The prior art business model utilizes very expensive, long lead time, rugged tooling to produce multiple ceramic casting vessels (and subsequently cast metal parts) from a single master tool with rapid injection and curing times. In contrast, the new regiment disclosed herein utilizes a less expensive, more rapidly produced, less rugged master tool and an intermediate flexible mold derived from the master tool to produce the ceramic core with much slower injection and curing times. Thus, the new casting regiment can be advantageously applied for rapid prototyping and development testing applications because it enables the creation of a first-of-a-kind ceramic core (and subsequently produced cast metal part) much faster and cheaper than with the prior art methods. Furthermore, the new regiment may be applied effectively in high volume production applications because multiple identical flexible molds may be cast from a single master tool, thereby allowing multiple identical ceramic cores to be produced in parallel to match or exceed the production capability of the prior art methods, in spite of the longer casting time required per core due to low pressure injection and potentially longer curing times. The time and cost savings of the present regiment include not only the reduced cost and effort of producing the master tool, but also the elimination of certain post-casting steps that are necessary in the prior art, such as drilling trailing edge cooling holes, since such features may be cast directly into the metal part using a ceramic core formed in accordance with the present invention due to the degree of precision achievable with the precision inserts and the ability to remove the flexible mold in multiple pull planes. The present invention not only produces high precision parts via a flexible mold, but it also enables part-to-part precision to a degree that was unattainable with prior art flex mold processes. Finally, the present regiment provides these cost and production advantages while at the same time enabling the casting of design features that heretofore have not been within the capability of the prior art techniques. thereby for the first time allowing component designers to produce the hardware features that are necessary to achieve next generation gas turbine design goals. For example, the prevent invention facilitates the production of a ceramic core having an overall outer envelope dimension aspect ratio of 20:1 or higher, and/or having an overall length of 30 inches or more. Thus, the present invention permits the commercial production of next generation actively cooled $4^{th}$ stage turbine blades which is impossible with prior art techniques. It is also now possible to incorporate such large hollow regions in large cast components in order to reduce weight even if cooling is not a requirement.

While various embodiments of the present invention have been shown and described herein, it will be obvious that such embodiments are provided by way of example only. Numerous variations, changes and substitutions may be made without departing from the invention herein.

What is claimed is:

1. A method for forming a ceramic core for an investment casting process, the method comprising:

defining a geometry of a ceramic core;

forming first and second flexible mold parts, each formed from a tooling surface comprising a hybrid of a machined surface and an insert surface to cooperatively define a negative of the ceramic core geometry, the forming of the first and second flexible mold parts comprising embedding vibrators in the first and second flexible mold parts;

combining the first and second flexible mold parts to define a cavity;

activating the vibrators to vibrate the first and second flexible mold parts while filling the cavity with a ceramic composition;

from the ceramic composition, forming the ceramic core for investment casting having a green body state modulus of rupture of at least 4,000 psi within the first and second flexible mold parts; and removing the ceramic core from the cavity in a green body state without damaging the ceramic core.

2. The method of claim 1, further comprising:

forming the first flexible mold part by casting the first flexible mold part in a master tool; and forming the second flexible mold part by casting the second flexible mold part in the master tool, wherein the master tool comprises a first portion defined by a machining process to form the machined surface and a second portion defined by an insert incorporated into the master tool to form the insert surface.

3. The method of claim 1, further comprising:

forming a plurality of identical production molds from a single master tool;

casting ceramic core material into each of the identical production molds in a parallel process to form a plurality of identical ceramic cores;

wherein a number of molds in the plurality of production molds is selected to achieve a predetermined production rate.

4. The method of claim 1, wherein:

the ceramic core has a green body state modulus of rupture of at least 8,000 psi within the first and second flexible mold parts.

5. The method of claim 1, wherein:

the ceramic core has an outer envelope dimension with an aspect ratio of at least 20:1 and a length of 30 inches or more.

6. The method of claim 1, wherein:

the ceramic core defines two geometric details defining non-parallel pull planes.

7. The method of claim 1, wherein the forming of the ceramic core includes curing the ceramic composition in the first and second flexible mold parts at 110° C. for 3 hours.

8. The method of claim 1, wherein the ceramic composition includes an epoxy content between 3 weight to 28 weight in a silica based slurry.

9. The method of claim 8, wherein the ceramic composition includes a silicon resin content of 3 weight % to 30 weight %.

10. The method of claim 4, wherein the forming of the ceramic core further includes curing the ceramic composition in the first and second flexible mold parts at 120° C. for one hour.

11. The method of claim 1, wherein the ceramic composition is a slurry during the filling of the mold and comprises:

an epoxy content between 3 weight to 28 weight %;

a silicon resin content of 3 weight % to 30 weight %; and silica of 200 mesh or more.

12. A method for forming a ceramic core for an investment casting process, the method comprising:

forming first and second rubber mold parts, each formed from a tooling surface comprising a hybrid of a machined surface and an insert surface to cooperatively define a negative of a ceramic core geometry, the forming of the first and second rubber mold parts comprising embedding vibrators in the first and second rubber mold parts;

combining the first and second rubber mold parts to define a cavity;

activating the vibrators to vibrate the first and second rubber mold parts while filling the cavity with a ceramic slurry;

heating the ceramic slurry within the cavity to form the ceramic core; and removing the ceramic core from the cavity in a green body state without damaging the ceramic core.

13. The method of claim 12, wherein the embedding of the vibrators in the first and second rubber mold parts comprises embedding a substantial entirety of each of the vibrators in multiple distinct locations throughout each of the first and second rubber mold parts.

14. The method of claim 12, wherein the ceramic slurry comprises:

an epoxy content between 3 weight % to 28 weight %;

a silicon resin content of 3 weight % to 30 weight %; and silica of 200 mesh or more.

15. The method of claim 12, wherein the heating of the ceramic slurry comprises heating the ceramic slurry such that the ceramic core is formed with a green body state modulus of rupture of at least 4,000 psi.

16. The method of claim 12, wherein the heating of the ceramic slurry comprises heating the ceramic slurry such that the ceramic core is formed with a green body state modulus of rupture of at least 8,000 psi.

17. A method for forming a ceramic core for an investment casting process, the method comprising:

forming first and second flexible mold parts, each formed from a tooling surface comprising a hybrid of a machined surface and an insert surface to cooperatively define a negative of a geometry of a ceramic core;

combining the first and second flexible mold parts to define a cavity;

filling the cavity with a ceramic composition;

forming the ceramic core for use in an investment casting process from the ceramic composition within the cavity, wherein the ceramic composition and the execution of the forming are provided such that the ceramic core is formed within the cavity in a green body state with a modulus of rupture of at least 4,000 psi; and removing the ceramic core from the cavity in the green body state without damaging the ceramic core.

18. The method of claim 17, wherein the ceramic composition is a slurry during the filling of the first and second flexible mold parts and comprises:

an epoxy content between 3 weight % to 28 weight %;

a silicon resin content of 3 weight % to 30 weight %; and silica of 200 mesh or more.

19. The method of claim 18, wherein the ceramic core is formed within the cavity in the green body state with a modulus of rupture of at least 8,000 psi.

* * * * *